US005653508A

United States Patent [19]

Carney

[11] Patent Number: 5,653,508

[45] Date of Patent: Aug. 5, 1997

[54] CHIMNEY DEMOLITION DEVICE AND METHOD

[76] Inventor: Gary Lee Carney, 18 Evergreen, Poca, W. Va. 25159

[21] Appl. No.: 515,192

[22] Filed: Aug. 15, 1995

[51] Int. Cl.[6] ..... E21C 9/00

[52] U.S. Cl. ..... 299/15; 299/18; 299/66

[58] Field of Search ..... 299/15, 18, 35, 299/66; 182/12, 37; 249/17

[56] References Cited

U.S. PATENT DOCUMENTS

| | | | |
|---|---|---|---|
| 3,761,551 | 9/1973 | Ogata et al. | 264/33 |
| 4,207,066 | 6/1980 | Weldon | 432/225 |
| 4,270,456 | 6/1981 | Theurer et al. | 104/3 |
| 4,462,951 | 7/1984 | Martin | 264/334 |
| 4,546,852 | 10/1985 | Martin et al. | 182/12 |
| 5,511,268 | 4/1996 | Albus et al. | 14/77.1 |

*Primary Examiner*—Frank Tsay

[57] ABSTRACT

An apparatus and method is provided for demolishing concrete chimneys. The apparatus for demolishing concrete chimneys from the top downward comprises: (a) a first support, (b) a second support, (c) means for forcibly vertically moving the supports relative to each other, (d) a crane carried by said first support, and rotatably attached through an upright axis, and (e) means for power actuated rotation of the crane about the upright axis. A method for demolishing a concrete chimney from the top down is also provided, wherein the method comprises (a) placing the above apparatus on the top of the chimney, (b) demolishing sections of the chimney under the second support, (c) lowering the second support until the second support is supported by portions of the chimney remaining under where the demolished sections had been, (d) demolishing sections of said chimney which are at an elevation of the previously demolished sections leaving sections directly beneath first support, (e) raising the first support, (f) demolishing the sections directly beneath the first support, (g) repeating steps (b)–(f) to demolish the chimney in step-wise fashion. The apparatus and method provide for controlled efficient demolition of concrete chimneys.

13 Claims, 10 Drawing Sheets

CHIMNEY DEMOLITION DEVICE AND METHOD

BACKGROUND OF THE INVENTION

1. Field of the Invention

This invention relates to chimney demolition equipment and methods related thereto, and more particularly relates to chimney demolition equipment for demolishing chimneys from the top down and methods for demolishing chimneys.

2. Description of the Related Art

Historically, chimney demolition techniques have involved utilizing explosions, long boom crane demolition from the ground, and sawing and dropping of small pieces uncontrolled to the ground. Chimneys utilized in the power generation industry typically range from 200 feet to 1500 feet in height and have diameters of 40 feet to 120 feet with a taper that varies from vertical plumb to an approximate 2 percent taper. The power generation industry is in the process of building new chimney stacks having scrubbers to meet various environmental requirements. Typically these new chimney stacks will be constructed adjacent the old chimney stacks in order to avoid costly erection of long runs of inlet and outlet gas ducts, but results in the need to economically demolish these old chimneys in a controlled manner to maintain a stable stack during the demolition to minimize the risk of damaging the surrounding power station facilities.

Accordingly, there is a need for an apparatus and method for controlled demolition of chimney stacks.

SUMMARY OF THE INVENTION

A chimney demolition apparatus and chimney demolition method are provided. The apparatus has first and second supports and means for power actuated vertical relative movement of the supports, and the first support carries a crane rotatable about an upright axis which carries means for selectively carrying portions of the concrete chimney. The apparatus is operated in a step-wise fashion where chimney sections beneath the second support are removed to a certain lower level and the second support is lowered to that level to provide the apparatus with structural support through both the first and second supports; the remaining chimney section above that lower level are then removed (demolished) but leaving the sections directly beneath the first support effectively providing piers therebeneath; the first support is then raised to a position above the piers and the piers (remaining sections) are demolished to the lower level of the first support, the second support is lowered to this lower level of the first support, and the method is repeated. The apparatus and method provide for controlled step-wise demolition (destruction) of the chimney tower (stack).

DETAILED DESCRIPTION OF THE INVENTION

Figure 1:
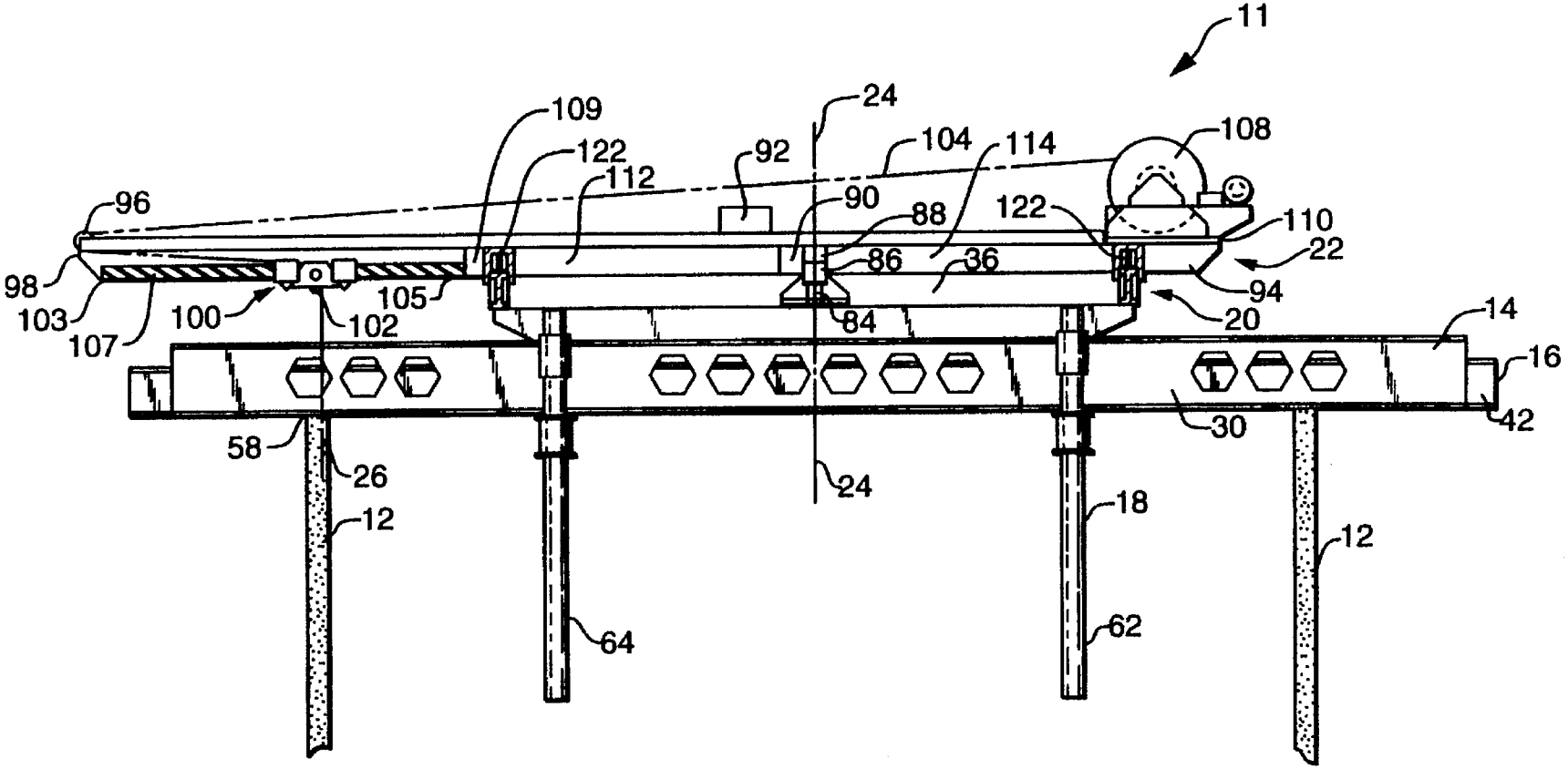
FIG. 1 is a side elevational view of the apparatus according to the present invention and position on the top of a chimney.

A chimney demolition apparatus (11) is provided for demolishing concrete chimneys (12). As best shown in FIG. 1, the apparatus preferably has (a) a first upper horizontal girder support (14), (b) a second lower horizontal girder support (16), (c) means (18) for forcibly vertically moving the first support (14) and the second support (16) relative to each other, (d) a crane (22) rotatably attached through an upright axis (24) to the first support (14), (e) means (26) for selectively carrying portions of a concrete chimney (12), the carrying means (26) are attached to the crane (22) for positioning by the crane (22).

Figure 5:
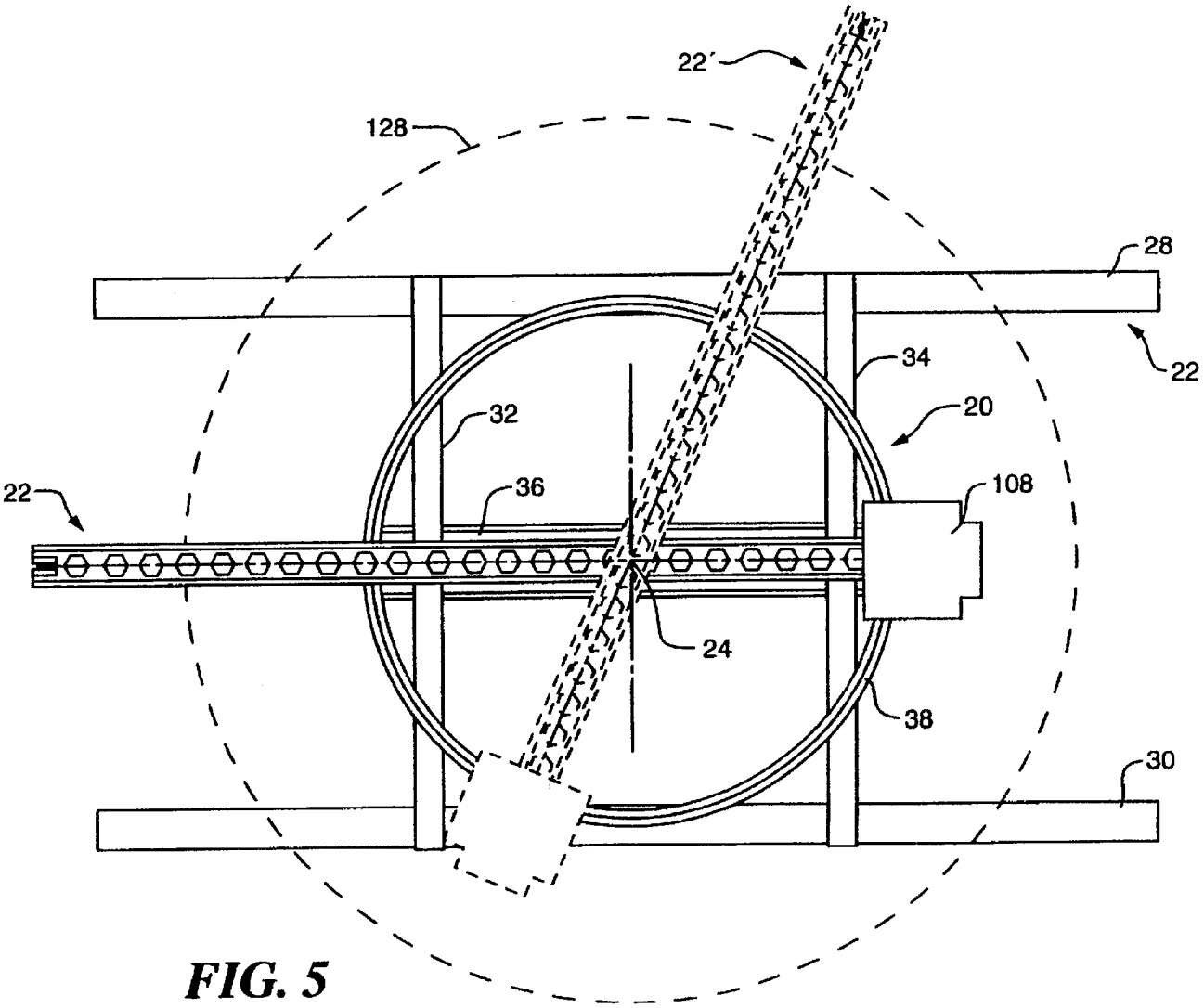
FIG. 5 is a top plan view of the crane and upper support of the apparatus of FIG. 1.
Figure 7:
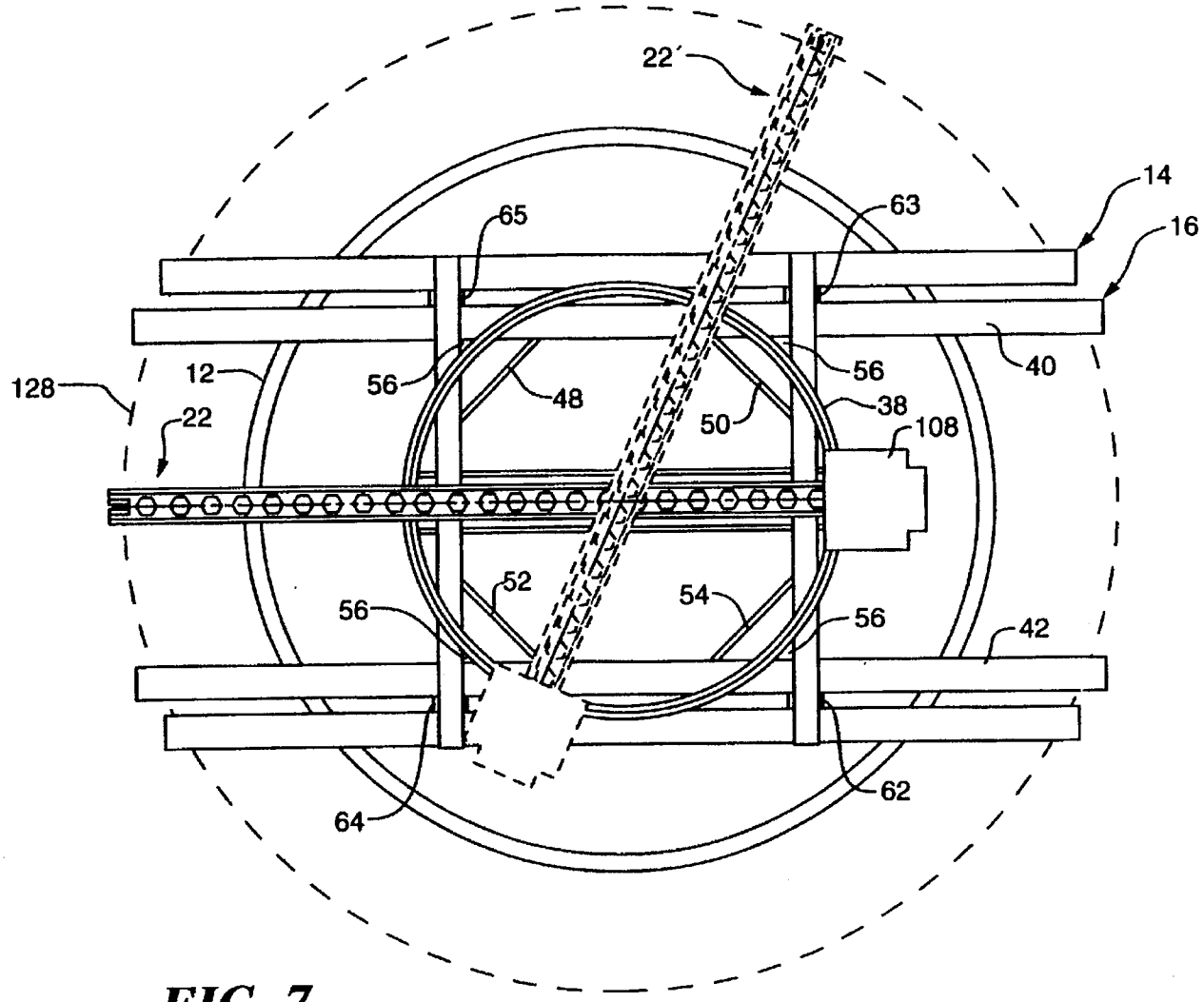
FIG. 7 is a top plan view of the apparatus of FIG. 1.

As best shown in FIG. 5 (and as shown in FIG. 7), the first support (14) preferably has a first pair of horizontally spaced apart parallel horizontal linear metal supporting I-beams (28, 30) which are fixedly held in position by a pair of horizontally spaced apart cross beams (32, 34) which are perpendicular to the I-beams (28, 30). The first support (14) preferably also has a horizontal carrying beam (36) parallel with the first pair of I-beams (28, 30) and positioned intermediate therebetween and level therewith. The carrying beam (36) is supported at its opposite end by respective cross beams (32, 34), forming a horizontal capital H shape. The first support (14) preferably also has a carriage (20) which preferably has a ring (circular shaped) rail (38) which is carried on the first support (14), and as shown in FIG. 5 is preferably supported at the 9 o'clock position by one end of carrying beam (36), at the 8 and 10 o'clock positions by cross beam (32), at the 12 o'clock position by I-beam (28), at the 2 and 4 o'clock positions by cross beam (34) and at the 6 o'clock position by I-beam (30).

Figure 2:
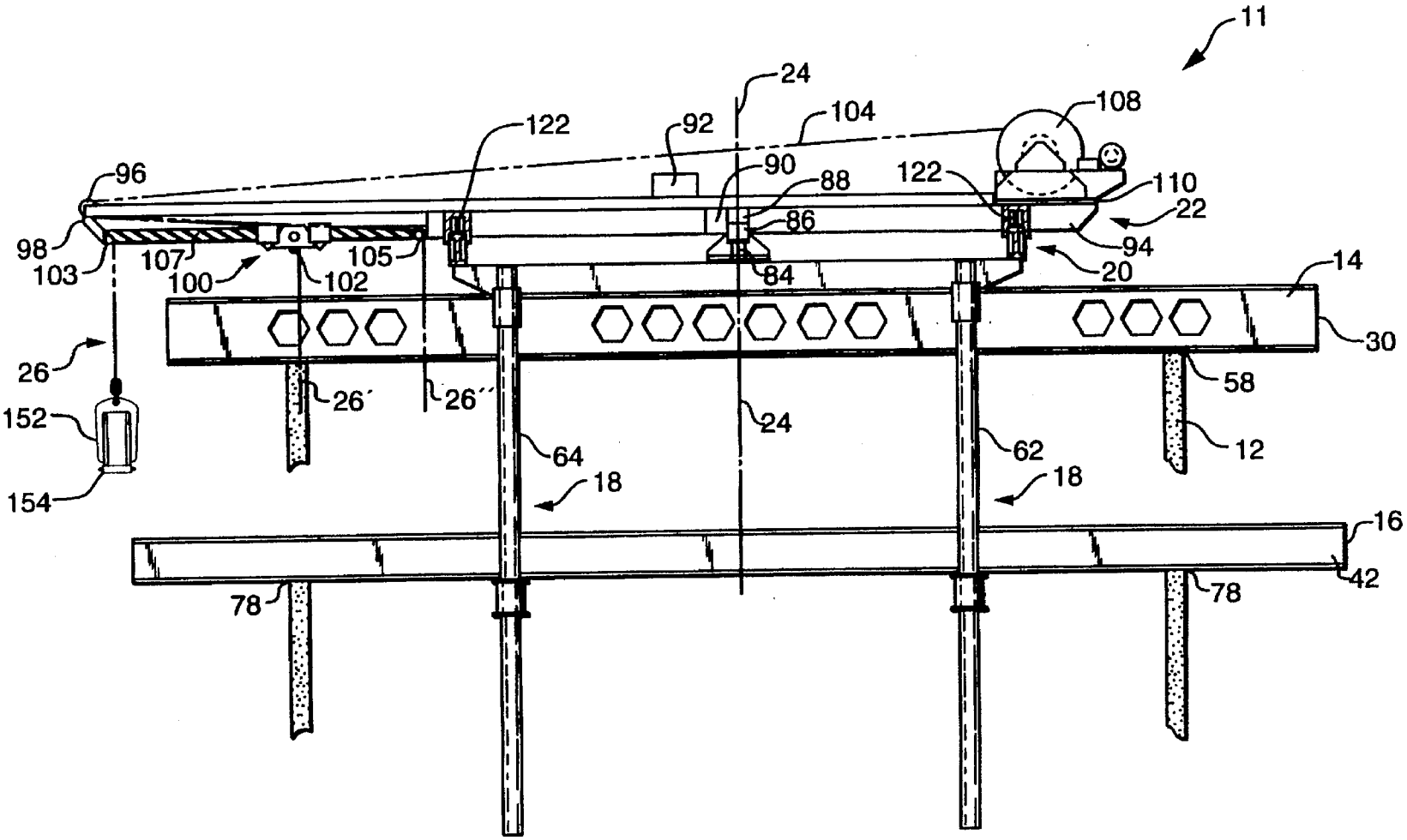
FIG. 2 is a side elevational view of the apparatus of FIG. 1 with the lower support unit lowered within cutaway slots in the chimney and the upper support being carried on remaining chimney pier portions.
Figure 6:
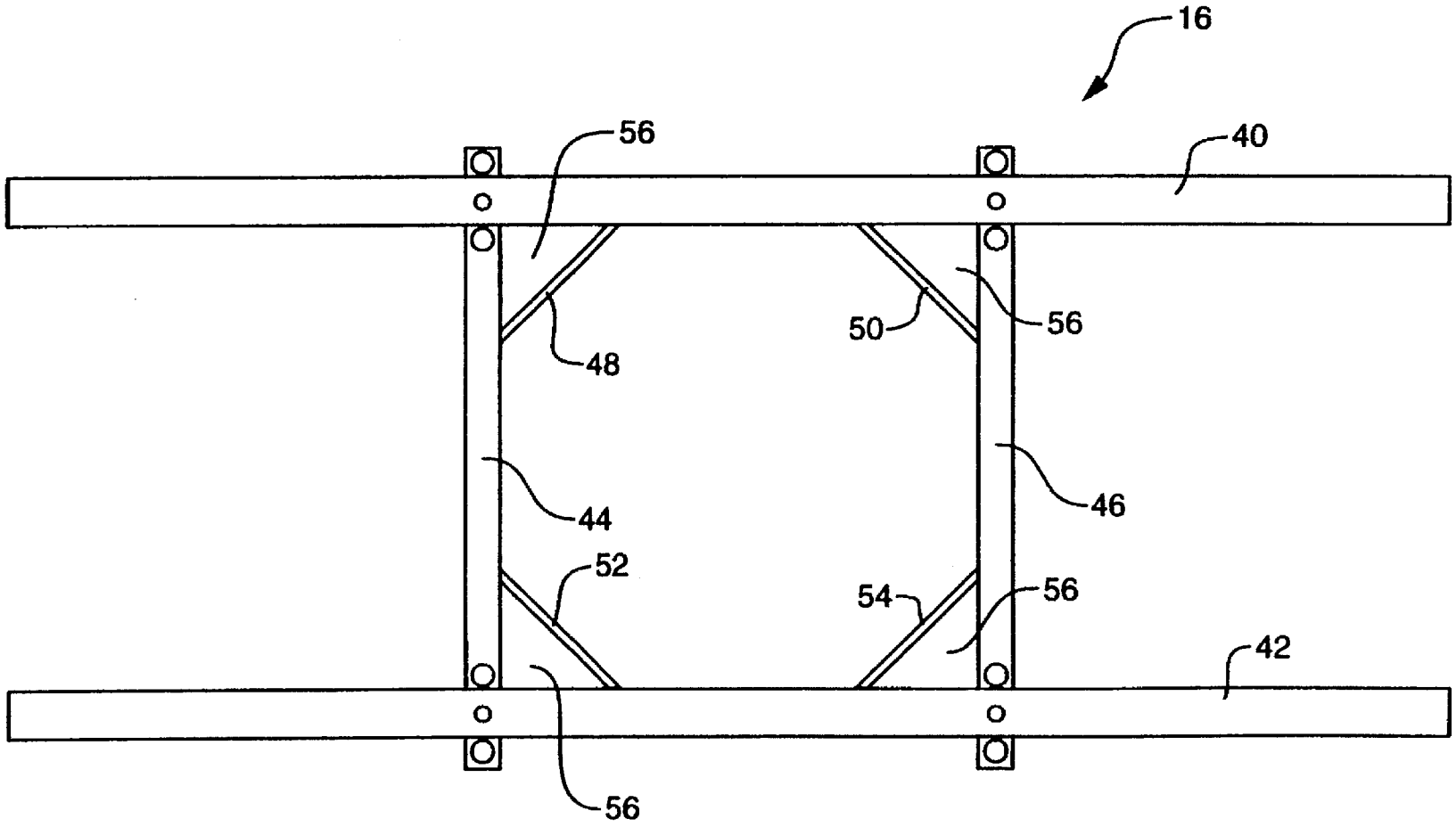
FIG. 6 is a top plan view of the lower support of the apparatus of FIG. 1.

As best shown in FIG. 6, the second support (16) comprises a second pair of horizontally spaced apart parallel horizontal linear metal I-beams (40, 42). The first support I-beams (28, 30) are preferably each parallel with the second support I-beams (40, 42). The I-beams (40, 42) are preferably shorter in height and longer in length than the I-beams (28, 30) as best shown in FIG. 2. The I-beams (40, 42) are fixedly interconnected by horizontally spaced apart crossing beams (44, 46) which are perpendicular to the I-beams (40, 42), and are preferably welded thereto. The spacing apart of the crossing beams (44, 46) is preferably approximately the same distance as the length of the crossing beams (44, 46). The rigidity and strength of the second support (16) is preferably enhanced by the presence of bracing beams (48, 50, 52, 54) which extend across interior angles (56) of the square shape formed by the I-beams (40, 42) and crossing beams (44, 46).

Figure 4:
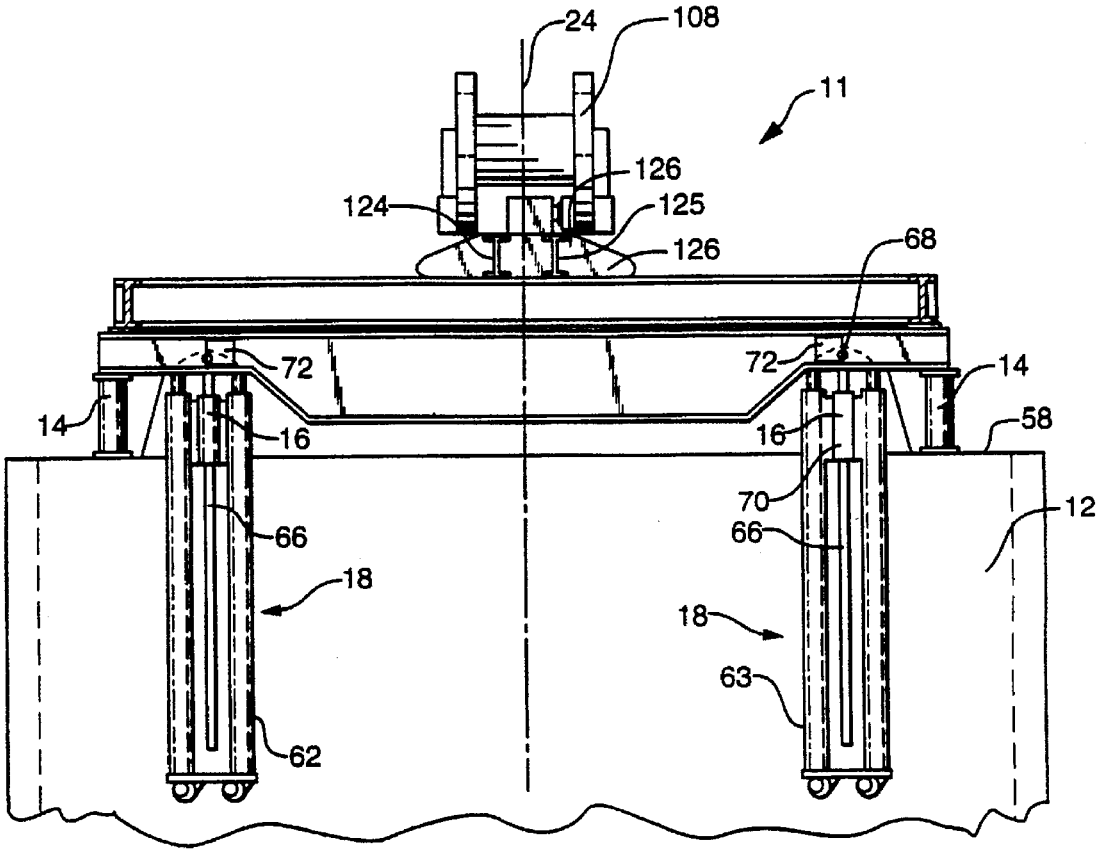
FIG. 4 is a rear elevational view of the apparatus of FIG. 1 with the lower support in its upper position.
Figure 9:
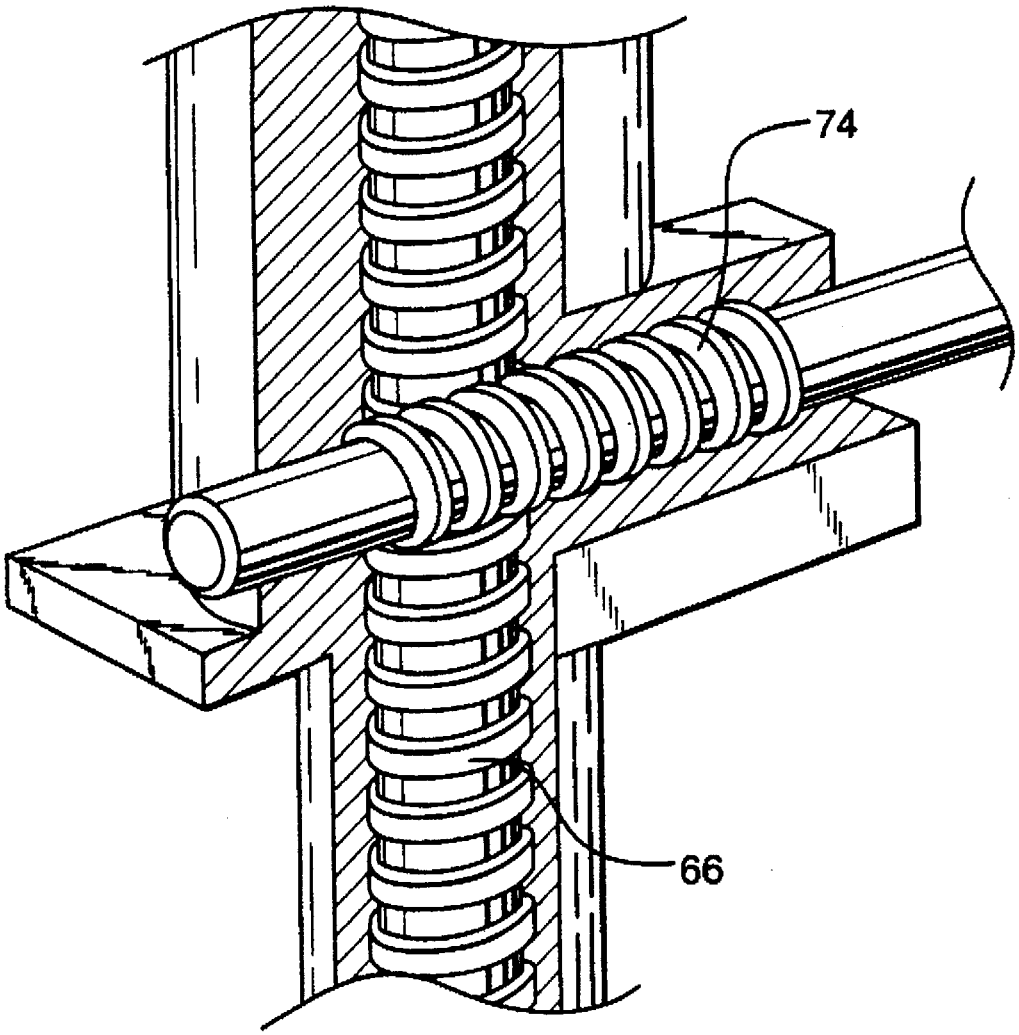
FIG. 9 is a perspective view of a worm gear screw jack of the apparatus of FIG. 1.

As best shown in FIG. 4, when the apparatus (11) is placed on the top of the chimney (12) (or is positioned on top of the remaining portion of the chimney (12) after having removed an upper portion of the chimney above a certain uniform level (elevation)), the first support (14) and second support (16) are supported by the top (58) of the chimney (12) (or the top of the remaining chimney segment). Assembly of the apparatus (11) on top of the chimney may be done in a piece by piece fashion using an air lift helicopter (not shown). In this initial position the bottoms of the support beams (28, 30) engage and are carried/supported by the top (58) of chimney (12) (or chimney segment). The first support (14) and second support (16) are structurally interconnected by the means (18) for forcibly vertically moving the first support (14) and the second support (16) relative to each other. The means (18) is preferably a set of four jacks (62, 63, 64, 65) (hydraulic or screw type) which each have a vertical rod (66) attached at its upper end (68) to a respective cross beam (32, 34) and have a collar (70) which receives the rod (68), and in the case of a screw type jack being utilized as means (18), the collar (70) has internal threads which threadably receive threaded rod (66) and each threaded rod (66) is forcibly rotated to control the position of the respective collar (70) along the rod (66) and to adjust the respective positions of first support (14) and second support (16). An electric motor (72) may be associated with each rod (66) (for example, through a worm gear (74) see FIG. 9) for rotation of the rod (66) and effective power actuation of each jack (62, 63, 64, 65).

Figure 3:
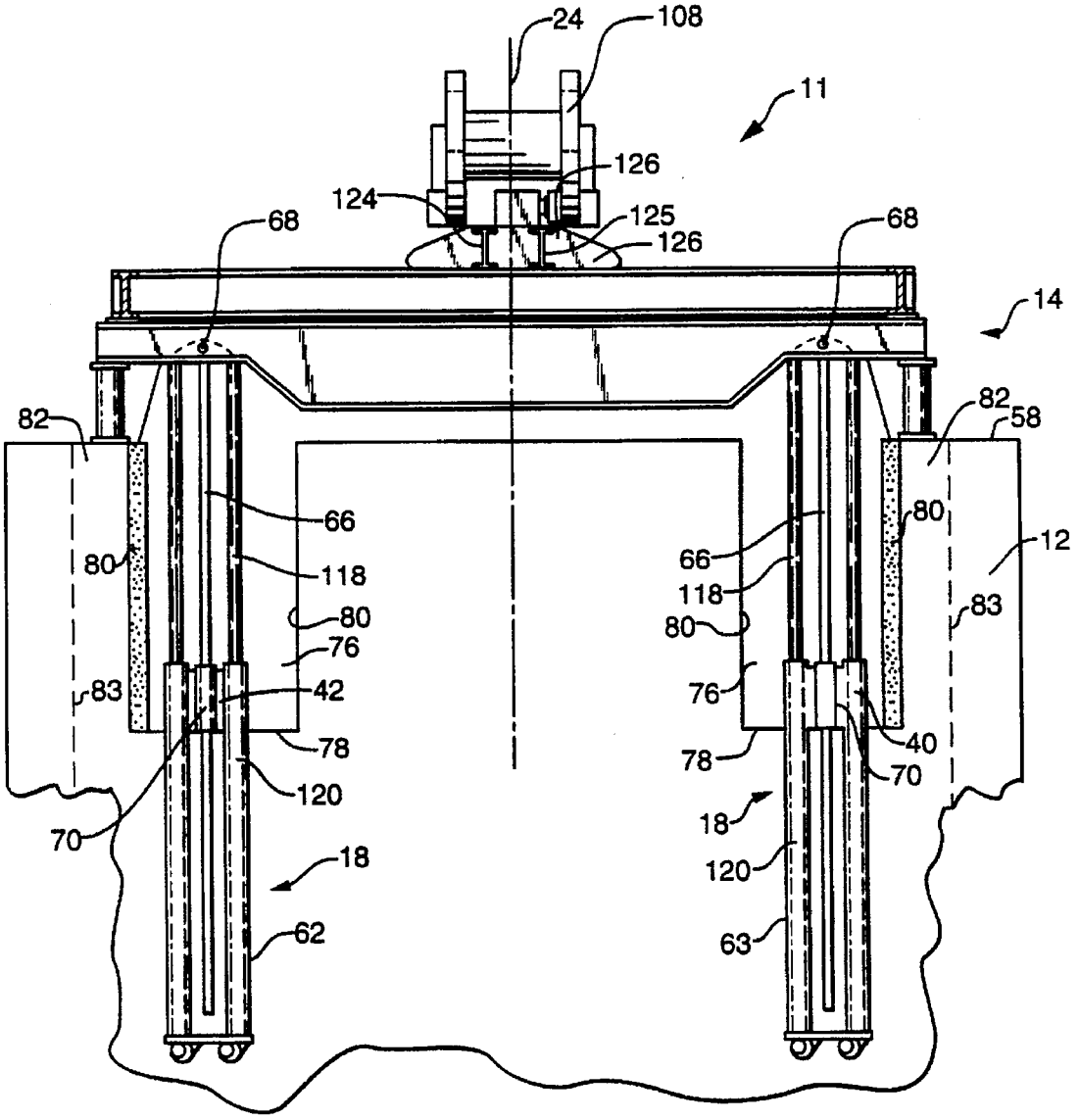
FIG. 3 is a rear elevational view of the apparatus of FIG. 2 with the lower support in its lowered position.
Figure 8:
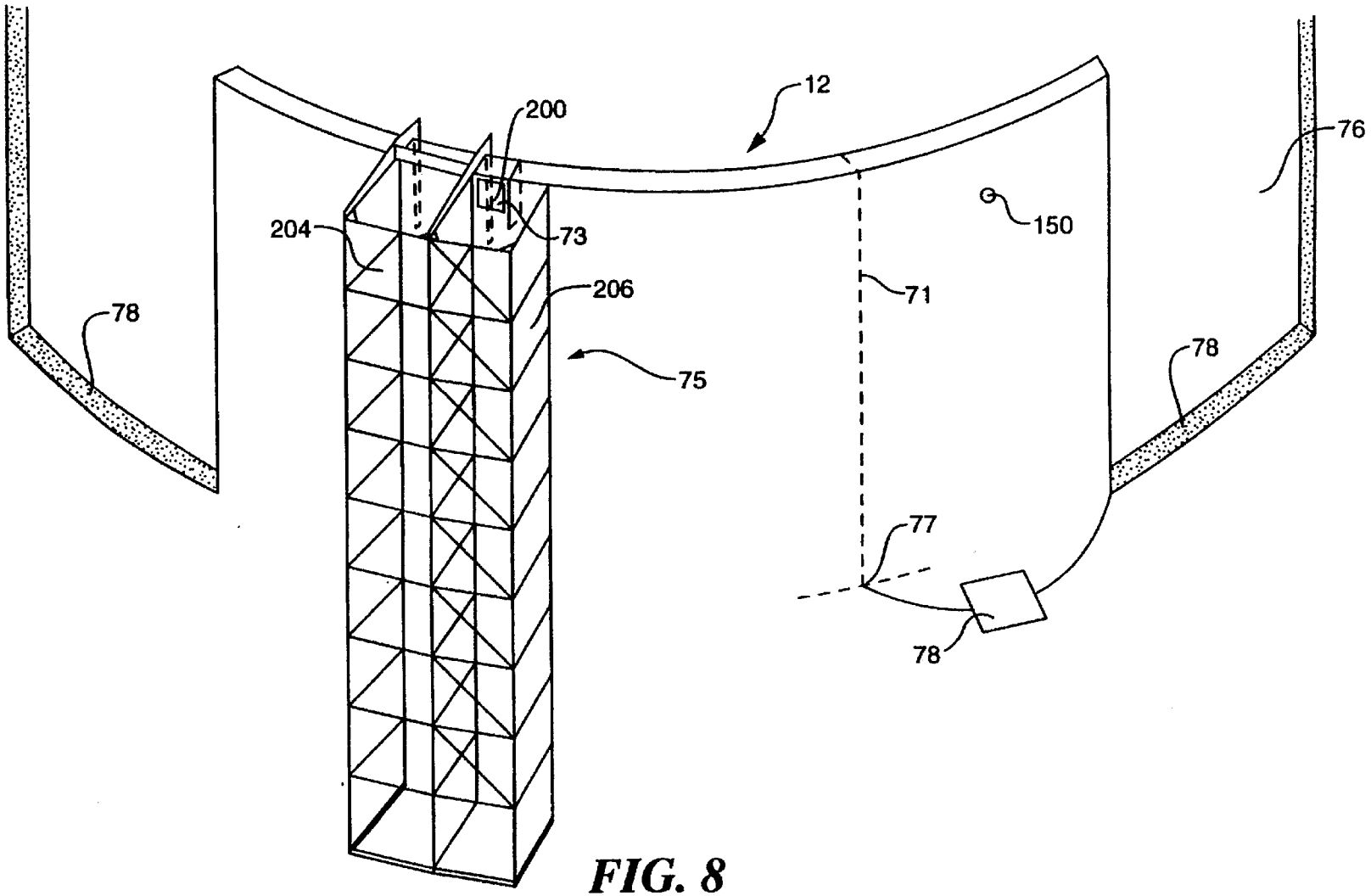
FIG. 8 is a perspective view of the buggy cart of the present invention attached to the chimney.

As best shown in FIG. 3, power actuation of the means (18) (jacks 62, 63, 64, 65) effectively adjusts the respective positions of the first support (14) and second support (16) from the position shown in FIG. 4. The cutting means (73) is utilized for cutting (demolishing) portions (for example, 10 feet by 10 feet square portions) of the chimney (12) directly beneath the second support's (16) respective I-beams (40, 42) to form vertical slots (76) and then the I-beams (40, 42) are lowered until they are supported at a level (elevation) at the base (78) of the slots (76). As best shown in FIG. 8, cutting is preferably done by making vertical cuts (71) using a circular saw (200) which follows a vertical track within a cutting buggy (75). The lower horizontal cut is preferably achieved by utilizing a wire cutting device (202) incised through a hole (77). The vertical and horizontal cut may be made by any suitable cutting means. As shown in FIG. 3, the apparatus (11) is supported at an upper elevation (top 58) by the first support (14) engaging the top (58) of the chimney (12) (or the top of the remaining segment of the chimney stack) and at a lower elevation (slot base (78)) by the second support (16) engaging the base (78) of the slot (76). The upper elevation (top 58) is preferably 10 to 12 feet above the lower elevation (base 78). Each slot (76) preferably has vertical sides (80). A side elevation view of this dual elevation support is shown also in FIG. 2. Once the slot (76) has been created and the second support (16) has been lowered to the base (78) of the slot (76), the carrying means (26) can be utilized to remove carry and lower remaining portions of the chimney from above the elevation of the base (78) after respective cutting until only piers (82) directly beneath the I-beams (30, 32) are left standing above the elevation of the base (78). The piers (82) are illustrated in FIG. 3 as the chimney portions between outer side (80) and dashed vertical lines (83). When only the piers (82) remain above the elevation of base (78), the means (18) is actuated and the first support (14) is raised off of the top (58) and the entire weight of the apparatus (11) is supported by the second support (16). The carrying means (26) is then utilized to carry the pier portions (82) after cutting thereby leaving only the chimney segments from elevations of slot base (78) downward which in effect then becomes the remaining chimney stack segment's top and the stepwise process (method) is repeated.

As shown in FIG. 1, the crane (22) is carried on the carriage (20) of the first support (14). The carrying beam (36) of the first support (14) has a vertical pin (84) extending upwardly from the mid point thereof and which is partially received (smooth end section) by a vertical support collar (86) depending from the boom (94). The pin (84) has gear teeth (88) (mid section) which mesh with the teeth of gear drive (90) which is powered by electric drive motor (92) for 360° rotation of the crane about the upright axis (24) for selective positioning of the carrying means (26). The crane (22) has a boom (94), an outer pulley (96) (or rollbar) at the distal end (98) of the boom (94), a guide trolley (100) having a guide pulley (102) for guiding cable (104) into horizontal positions along the boom (94). As illustrated in FIG. 1, the trolley (100) is movable along the boom (94) throughout a variety of positions such as the extreme positions (103 and 105). The trolley may be operated by a worm gear (107) and an electric motor (109) for moving the trolley along the distal end section of the boom (94). The crane (22) also has an electric motor driven winch (108) for feeding and retrieving cable (104). The crane (22) is preferably weight balanced about the axis (pin 89), and consequently, the winch (108) is preferably positioned on the opposite end (110) relative to the distal end (98), and preferably the boom segment (112) extending from the collar (86) to the distal end (98) is longer than the boom segment (114) extending from the collar (86) to the end (110).

The cutting means (73) may be any suitable tool for demolishing (removing) portions of the chimney wall (12) (and/or chimney liner), and as shown in FIG. 8, one suitable means (73) is a combination of a circular saw (200) having a saw blade (203) for making the vertical cuts and a wire loop saw (202) for making the horizontal cuts. The jacks (62, 63, 64, 65) have rods (118) slidably received in hollow cylinders (120), and the rods (118) are affixed at one (upper) end to the first support (14) and are received at the other (lower) end by the respective hollow cylinder (120). The cylinder is attached at its upper end to the second support (16) and its upper end receives the rod (118).

The crane (22) has rollers (122) rotatably attached to the underside of the boom (94) for riding on the upper surface of the ring rail (38). The ring rail (38) in combination with the rollers (122) carries the weight of the boom segments (112, 114) while the boom (94) is any position along its circular path about axis (24).

The boom (94) is preferably in the form of a double (duplex) I-beam (124, 125), which are strengthened with plates (126).

The 360° circle of rotation is illustrated as dashed line (128).

Figure 10:
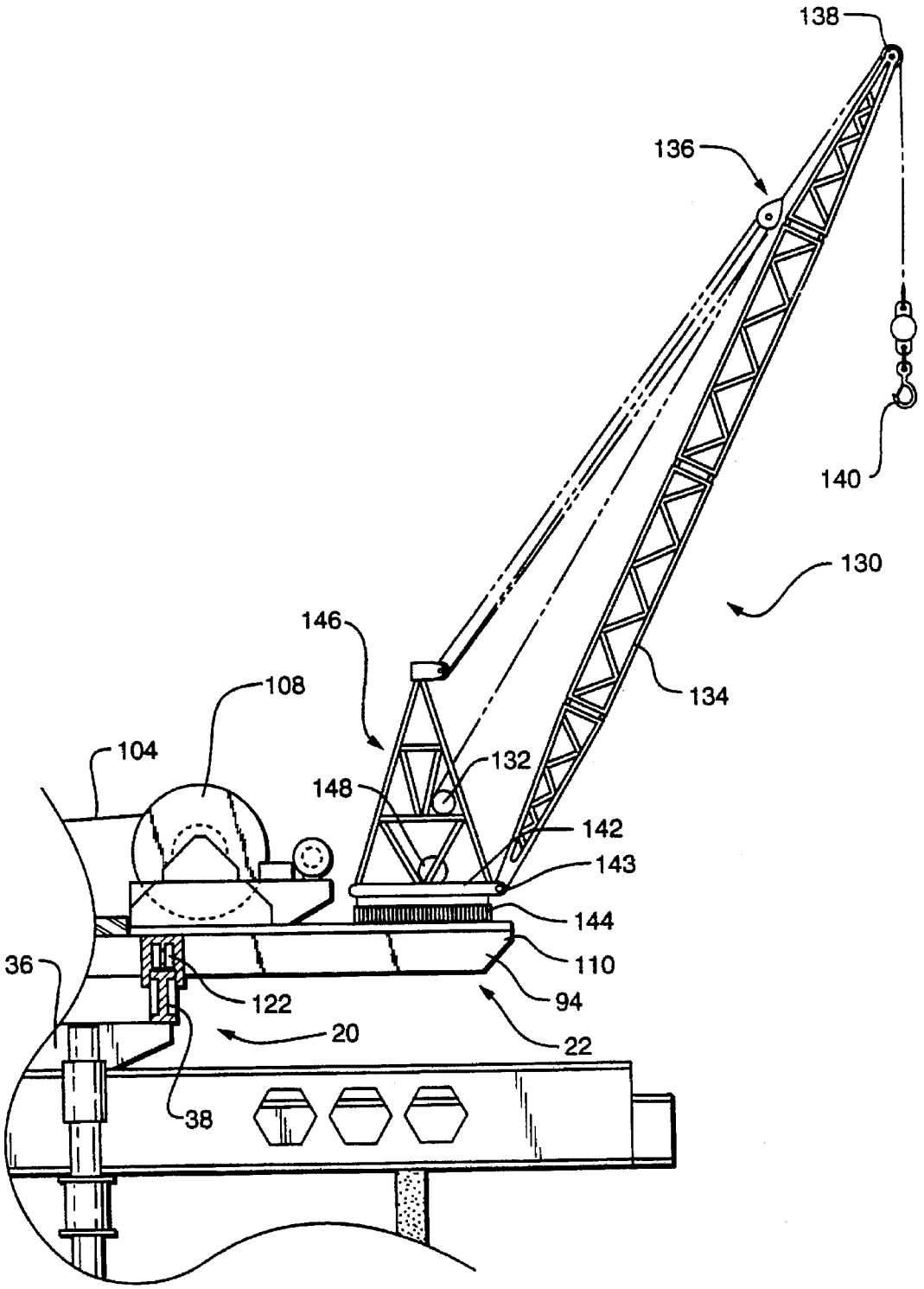
FIG. 10 is a side elevational view of the optional derrick of the apparatus.

Preferably, as shown in FIG. 10, the apparatus (11) further includes a derrick (130), which has a derrick winch (132), a derrick arm (134), a derrick pulley (136), a roller (138) at the top of arm (134), and hook (140). The arm (134) is pivotally attached (about a horizontal axis pin (143)) to the derrick base (142), and the base (142) is rotatable about vertical axis for 360° rotation of the derrick. The base (142) is carried on a support platform (144) carried on the rearward end of boom (94). Rotation of the derrick may be powered by a motor (148). The derrick preferably has an A-frame support structure (146) extending upwardly from the base (142). The hook (140) can be used for moving cutting buggy (75) to various cutting positions along the top (58) of the chimney (12) (or top of the remaining chimney).

The demolition process preferably involves (a) making a vertical cut (or cuts) for a chimney portion to be removed, (b) drilling (or cutting) a carrying hole (150) near the top of the portion, (c) attaching the carrying means cable to the portion such as by placing a metal u-shaped member (152) over the top of the portion and fitting a pin (154) through the carrying hole in the portion and through the u-shaped member (152) to permit the portion to be carried by the carrying means. As shown in FIG. 2, 26, 26' and 26" are the carrying means in alternative positions. In FIGS. 5 and 7, 22 and 22' are the crane in alternative positions. In FIG. 7, 128 is the dashed line representing the circle of rotation for the crane as would be followed. During the vertical cuts, the cutting buggy (75) could house the worker in the left side (204), and could house the automatic circular saw in the right side (206).

The present invention also involves a method for demolishing a concrete chimney from the top down, said method comprising (a) placing an apparatus on the top of the chimney, said apparatus comprising: (i) a first support, (ii) a second support, (iii) means for power actuated vertical movement of said first support relative to said second support, (iv) a crane supported by said first support, (v) means for power actuated rotation of said crane about an upright axis, and (vi) means for demolishing portions of said chimney, (b) demolishing sections of said chimney under said second support, (c) lowering said second support until it said second support is support by portions of said chimney remaining under where the demolished sections had been, (d) demolishing sections of said chimney which are at an elevation of the previously demolished sections leaving sections directly beneath first support, (e)raising the first support, (f) demolishing the sections directly beneath the first support, and (g) repeating steps (b)–(f) to demolish the chimney in step-wise fashion.

Preferably the sections demolished in step (b) have a width of between 1 foot and 20 feet, and have a height of between 2 feet and 20 feet.

More preferably, the sections demolished in step (b) have a width of between 5 feet and 15 feet, and have a height of between 5 feet and 15 feet.

Most preferably, the sections demolished in step (b) have a width of between 8 feet and 12 feet, and have a height of between 8 feet and 12 feet.

Preferably the first support is raised in step (e) an elevation of between 1 foot to 5 feet.

The present invention also involves a method for demolishing a concrete chimney, said method comprising: (a) providing an initial elevation at the top of the chimney, said apparatus comprising: a first support, a second support, a crane carried by said first support and rotatable about an upright axis, a saw carried by said crane for positioning thereby, (b) using said saw to remove any sections directly beneath said second support to a uniform elevation beneath said second support, (c) lowering said second support to said uniform elevation to be supported by sections beneath said uniform elevation,(d) using said saw to remove the remaining sections above said uniform elevation leaving sections directly beneath said first support, (e) raising said first support, (f) removing said sections beneath said first support to said uniform elevation, (g) lowering said first support to said uniform level, (h) repeating steps (a)–(f) to remove sections of said chimney above a lower uniform elevation.

Preferably the uniform elevation of step (b) is between 5 feet and 15 feet lower than the elevation of the first support.

I claim:

1. A chimney demolition apparatus for demolishing concrete chimneys from the top downward comprises:

(a) a first support, (b) a second support, (c) means for forcibly vertically moving the supports relative to each other, (d) a crane carried by said first support, and rotatably attached thereto through an upright axis, and (e) means for power actuated rotation of said crane about said upright axis.

2. The apparatus of claim 1 wherein said crane comprises a trolley for guiding a crane cable along a boom of the crane.

3. The apparatus of claim 2 wherein said first support comprises a first pair of horizontally spaced apart parallel horizontal linear metal I-beams, and wherein said second support comprises a second pair of horizontally spaced apart parallel horizontal linear metal I-beams, said first pair of I-beams and said second pair of I-beams being parallel with each other.

4. The apparatus of claim 3 wherein each of said first pair of I-beams has a greater vertical cross-sectional height than does each of the second pair of I-beams.

5. The apparatus of claim 4 wherein said means for forcibly vertically moving the supports relative to each other, comprises a first pair of vertical jacks interconnecting a first I-beam of the first pair of I-beams with a first I-beam of the first pair of I-beams with a first I-beam of the second pair of I-beams, and a second pair of vertical jacks interconnecting a second I-beam of the first pair of I-beams with a second I-beam of the second pair of I-beams.

6. A chimney demolition apparatus for demolishing concrete chimneys from the top downward, said apparatus comprising:

(a) a first pair of spaced apart horizontal girders, (b) a second pair of spaced apart horizontal girders, (c) at least one jack interconnecting said first pair of girders and said second pair of girders for power actuated vertical movement of said pairs of girders relative to each other, (d) a carriage supported by one of said pairs of girders, said carriage comprising a horizontal ring rail, (e) a crane rotatably attached through an upright to said carriage, said crane comprising a horizontal boom having a pair of wheels engaged with said ring for riding thereon, and (f) means for power actuated rotation of said crane boom about said upright axis.

7. A method for demolishing a concrete chimney from the top down, said method comprising (a) placing an apparatus on the top of the chimney, said apparatus comprising:

(i) a first support, (ii) a second support, (iii) means for power actuated vertical movement of said first support relative to said second support, (iv) a crane supported by said first support, (v) means for power actuated rotation of said crane about an upright axis, and (vi) means for demolishing portions of said chimney, (b) demolishing sections of said chimney under said second support, (c) lowering said second support until said second support is support by portions of said chimney remaining under where the demolished sections had been, (d) demolishing sections of said chimney which are at an elevation of the previously demolished sections leaving sections directly beneath first support, (e) raising the first support, (f) demolishing the sections directly beneath the first support, and (g) repeating steps (b)–(f) to demolish the chimney in step-wise fashion.

8. The method of claim 7 wherein said sections demolished in step (b) have a width of between 1 foot and 20 feet, and have a height of between 2 feet and 20 feet.

9. The method of claim 7 wherein said sections demolished in step (b) have a width of between 5 feet and 15 feet, and have a height of between 5 feet and 15 feet.

10. The method of claim 7 wherein said sections demolished in step (b) have a width of between 8 feet and 12 feet, and have a height of between 8 feet and 12 feet.

11. The method of claim 8 wherein said first support is raised in step (e) an elevation of between 1 foot to 5 feet.

12. A method for demolishing a concrete chimney, said method comprising:

(a) placing an apparatus on the top of the chimney, said apparatus comprising: a first support, a second support, a crane carried by said first support and rotatable about an upright axis, a saw carried by said crane for positioning thereby, (b) using said saw to remove any sections directly beneath said second support to a uniform elevation beneath said second support, (c) lowering said second support to said uniform elevation to be supported by sections beneath said uniform elevation, (d) using said saw to remove the remaining sections above said uniform elevation leaving sections directly beneath said first support, (e) raising said first support, (f) removing said sections beneath said first support to said uniform elevation, (g) lowering said first support to said uniform level, (h) repeating steps (a)–(f) to remove sections of said chimney above a lower uniform elevation.

13. The method of claim 12 wherein said uniform elevation of step (b) is between 5 feet and 15 feet lower than said second support.

* * * * *